United States Patent [19]

Bartolles

[11] 3,951,041

[45] Apr. 20, 1976

[54] BREECH MECHANISM WITH SEPARATE CLEARANCE FOR MISFIRED PRIMER CARTRIDGE

[75] Inventor: Rolf Bartolles, Ratingen, Germany

[73] Assignee: Rheinmetall G.m.b.H., Dusseldorf, Germany

[22] Filed: Dec. 9, 1974

[21] Appl. No.: 531,177

[30] Foreign Application Priority Data

Dec. 14, 1973 Germany ..... 2362131

[52] U.S. Cl. ..... 89/27 B; 89/24

[51] Int. Cl.[2] ..... F41F 11/02

[58] Field of Search ..... 89/24, 27 R, 27 B, 27 C

[56] References Cited

UNITED STATES PATENTS 1,095,558 5/1914 Dawson et al. ..... 89/27 B

*Primary Examiner*—Stephen C. Bentley

*Attorney, Agent, or Firm*—Ernest G. Montague; Karl F. Ross; Herbert Dubno

[57] ABSTRACT

A breech mechanism for a cannon has a slidable breech block on which is carried a slider that in turn carries a primer-cartridge magazine alignable with a chamber on the block. The slider is automatically driven in the opposite direction as the block when the latter is slid aside to remove fired ammunition and automatically ejects the spent primer cartridge in the breech block during this operation and loads a fresh one from the magazine. A hand crank allows the slider alone to be displaced back and forth between its end positions independent of the motion of the breech block when a primer cartridge misfires.

6 Claims, 7 Drawing Figures

FIG. 4
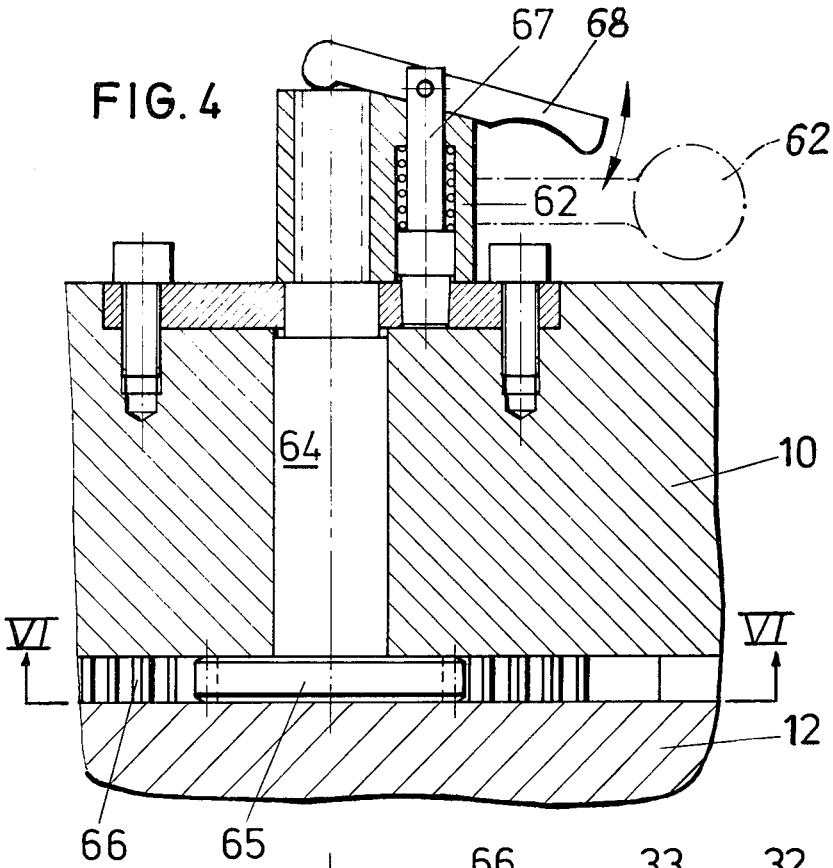
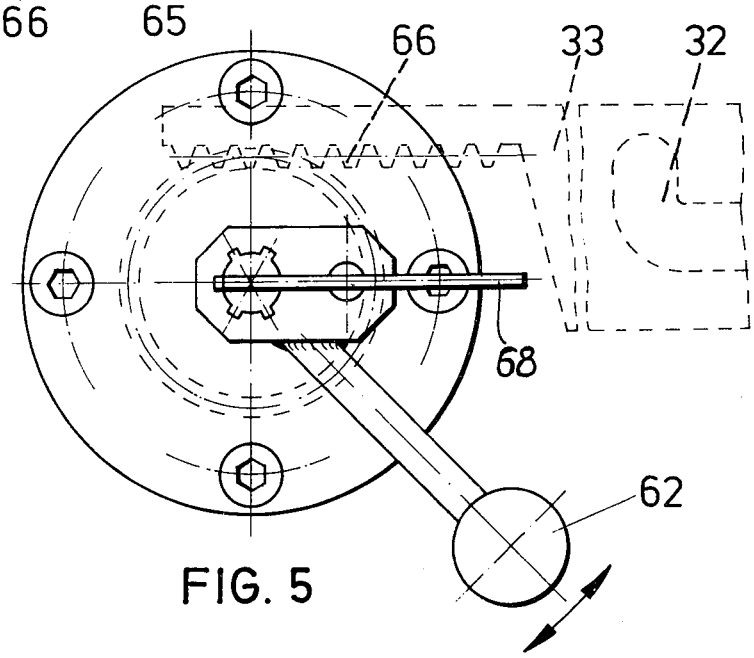
FIG. 5

BREECH MECHANISM WITH SEPARATE CLEARANCE FOR MISFIRED PRIMER CARTRIDGE

FIELD OF THE INVENTION

My invention relates to a breech mechanism for a cannon. More particularly this invention concerns a sliding breech block usable in a large-bore gun shooting ammunition set off by separate primer cartridges.

BACKGROUND OF THE INVENTION

There is known a gun breech mechanism including a primer-cartridge magazine which is insertable into a wedge-type breech block. A primer-cartridge chamber is provided on a plate pivotable on the barrel, a discharge lever for the fired primer cartridge being provided therein. The actuating member of the discharge lever is disposed in the breech block. Upon travel of the breech block the plate turns and operates another actuating member which introduces a new cartridge from the cartridge-holding magazine disposed in the breech block into the primer chamber. Upon shutting of the closure device the plate is returned to its starting position. The cartridge-holding magazine is formed in the shape of a disk and is advanced stepwise whenever the closure device is opened by guiding means formed with a groove. (Earlier systems are described in German Pat. No. 1,140,491 and German Auslegeschrift 1,128,788).

There is also known a gun having a wedge-type breech block and a cartridge-holding magazine which is also disk-shaped, disposed in the breech block and advanced stepwise by means of a stepping finger during opening thereof. The magazine also serves as primer chamber during firing. In the wedge-type breech block there is also disposed a discharge lever for fired cartridges which is actuated during opening of the breech block. To ensure discharge of a cartridge and advance of the magazine in the correct order without one operation interfering with the other, the firing mechanism and an associated firing pin are disposed in a plate guided in a breech member guided along the breech block within limited guidance paths.

OBJECTS OF THE INVENTION

It is accordingly an object of my invention to provide an improved breech mechanism.

It is in particular an object to increase reliability in the event of misfiring of a primer cartridge, and also to facilitate the removal of any cartridges remaining in the primer chamber and wedged therein upon firing.

It is a further object of my invention to provide a cartridge-holding magazine which is freely accessible and exchangeable, accessibility thereto and relatively simple manual actuation thereof being possible even when the breech block holds the weapon closed to remedy any possible malfunctioning of the weapon.

SUMMARY OF THE INVENTION

These objects are attained according to the present invention in a breech mechanism which includes a slider which is guided in the direction of motion of the breech block and which contains a firing pin and a magazine for carrying cartridges insertable into the slider and freely accessible when so inserted. A lever attached to the slider is guided in a groove formed therein and the slider is formed with an opening for discharging a cartridge and is either driven in a direction opposite to that of the breech block during respective opening or closing movements thereof, or is manually guided therein.

The weapon is advantageously designed so that a rack disposed on the slider meshes with a pinion disposed on the breech block and generates a relative movement between the latter and the slider, the pinion being actuated by a crank guided in a recess of a guide rail carried on the cannon.

According to another feature of the invention the slider is drivable via a second pinion rotatably supported on the breech plate and lockable in position thereon, the second pinion meshing with a second rack formed on the guide rail.

The invention provides significant advantages over the prior art:

The cartridge-holding magazine is easily and quickly changeable when the breech block is either in the firing or unloading position, and therefore permits a rapid rate of fire. Magazines of different sizes can be used and it is possible to ascertain the stock of primer cartridges remaining in the magazine. It is particularly advantageous that the magazine be exchanged quickly and easily even during high elevations of the barrel. An exact, but nevertheless robust drive for the slider is created by the latter being formed with a rack engaging a pinion disposed in the breech block and guided in a recess of the guide rail during movements thereof.

It is additionally advantageous that the motion of the breech block relative to the slider and to the breech plate can be utilized to cock the firing mechanism. This is preferably accomplished by a cocking device including a firing pin and actuated by the relative motion between the breech block and the slider.

BRIEF DESCRIPTION OF THE DRAWING

The above and other objects, features, and advantages will become more readily apparent from the following with reference to the accompanying drawing in which:

FIG. 4 is a section taken along line IV—IV of FIG. 1;

FIG. 5 is a top view of the detail shown in FIG. 4;

SPECIFIC DESCRIPTION

Figure 1:
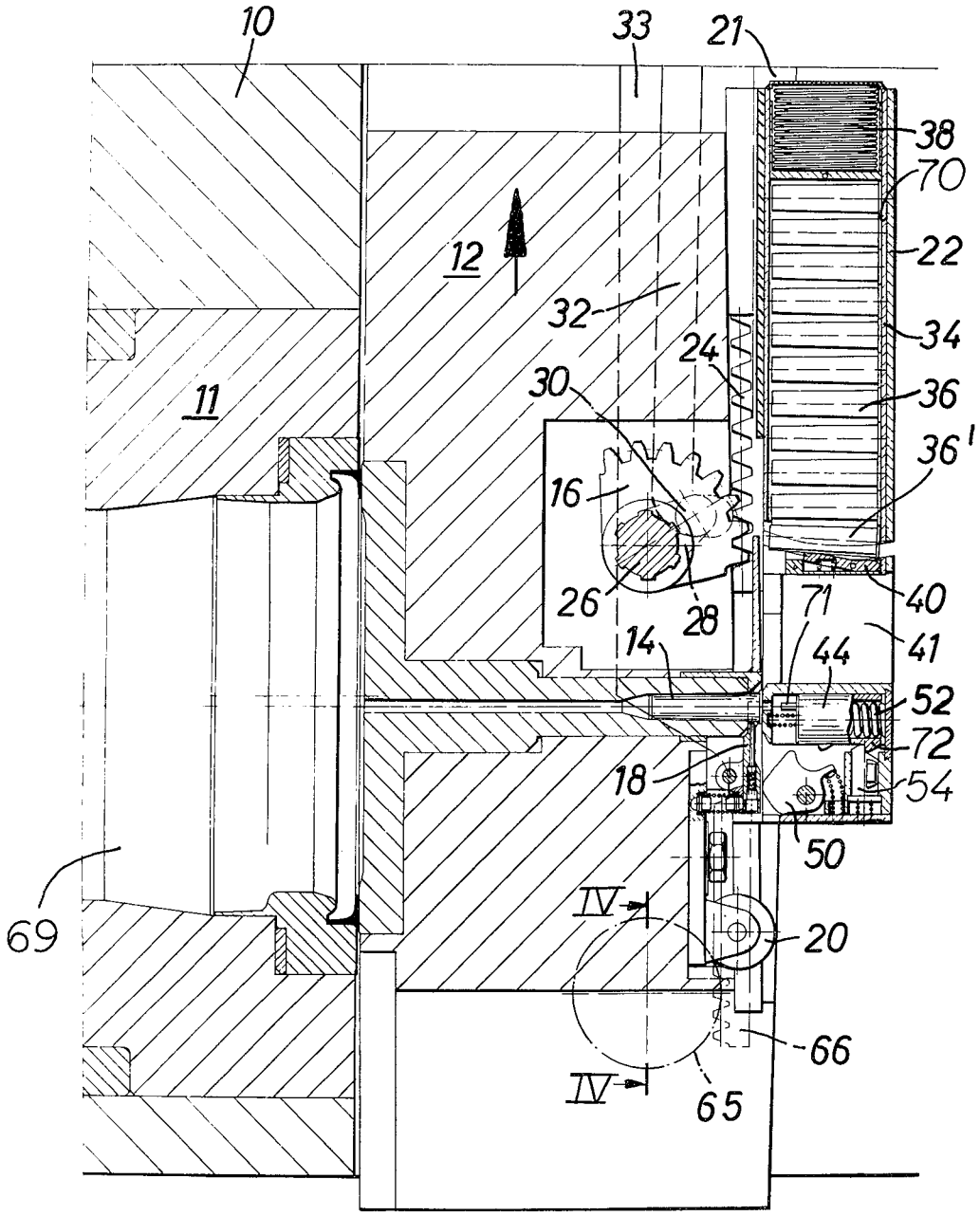
FIGS. 1, 2, and 3 are vertical sections taken through the breech mechanism according to the present invention in the firing position, an intermediate position, and the unloading position.

FIG. 1 shows a cannon 10 having a barrel 11 formed with an ammunition chamber 69 covered by a sliding wedge-type breech block 12 in the firing position and displaceable in the direction of arrow 12. This breech block 12 has a primer-receiving chamber 14 and carries a pinion segment 16. In addition there is disposed in the breech block 12 an ejector lever 18 as well as a roller 20 described below.

The breech block 12 is further formed with guide rails 21 for a slider 22 having a rack 24 meshing with the pinion segment 16 which is carried on a shaft 26 in turn carrying a crank 28. A crankpin 30 on the crank 28 is guided in an L-shaped elongated recess or cam slot 32 formed in a guide rail 33 normally fixed to the gun 10.

Figure 2:
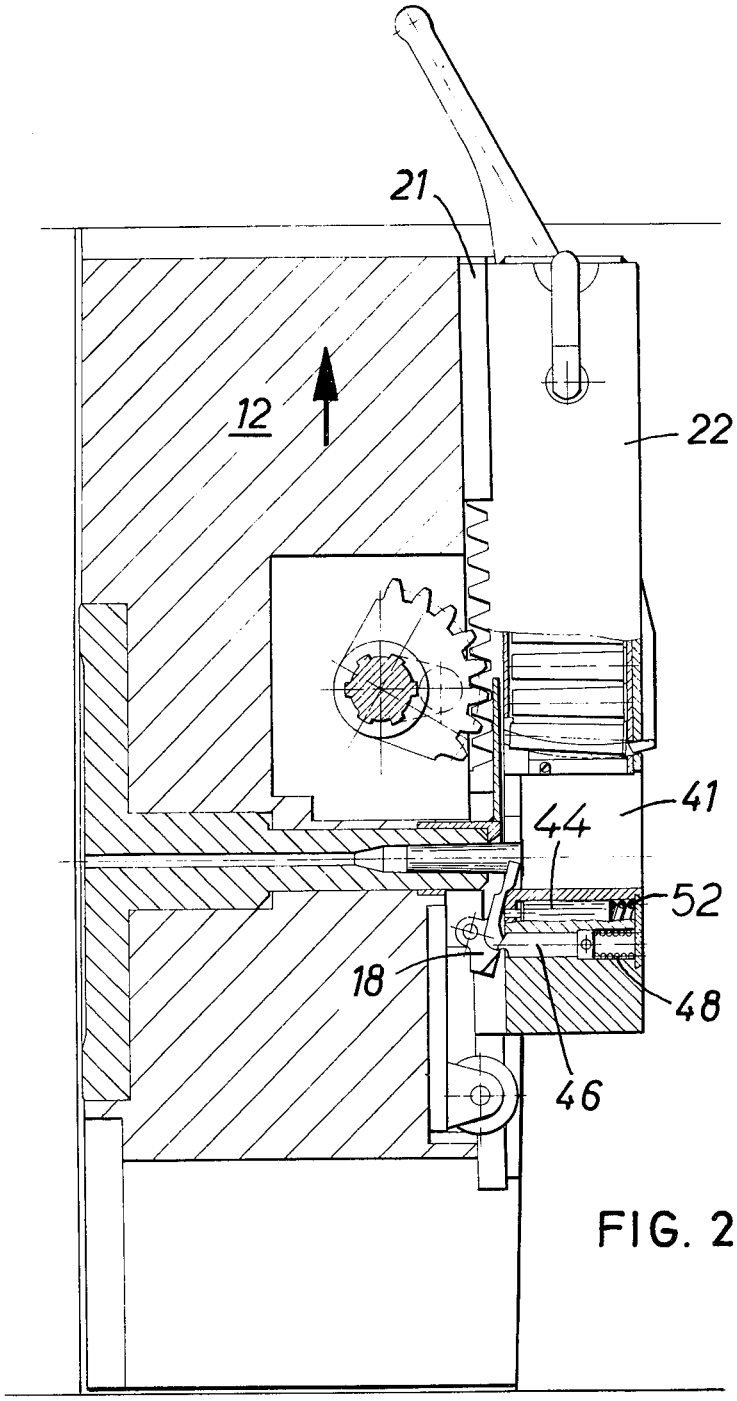

A clip 34 for holding cartridges 36 in a stack is held in a magazine 70 in the slider 22 with the primer cartridge 36 urged by a spring 38 in the direction of a tiltable detent 40 carried on the slider. In the lower part of slider 22 there are provided one above the other a firing pin 71 carried on a piston 44, a cocking cam 50, and an ejector pin 46 (FIG. 2) biased by a spring 48. The slider 22 is also formed with an ejector opening 41 below the magazine 70 for the ejection of spent or fired cartridges 36.

Assuming now that the weapon has been fired and that the breech block 12 is displaced upwardly into an unloading position, then crank pin 30 which lies in a foot part 32' of the L-shaped recess 32 is turned clockwise so that the gear wheel segment 16 pushes slider 22 in a direction opposite and parallel to that of the movement of breech block 12. The pin 46 (FIG. 2) then engages the actuating surface of the ejector lever 18 and the fired cartridge is ejected rearward through the opening 41. On closing of breech block 12 the ejector lever 18 will not be actuated because pin 46 is provided with an inclined surface and is pressed rearwards against the force of spring 48 by the spring loaded ejector 18.

Figure 3:
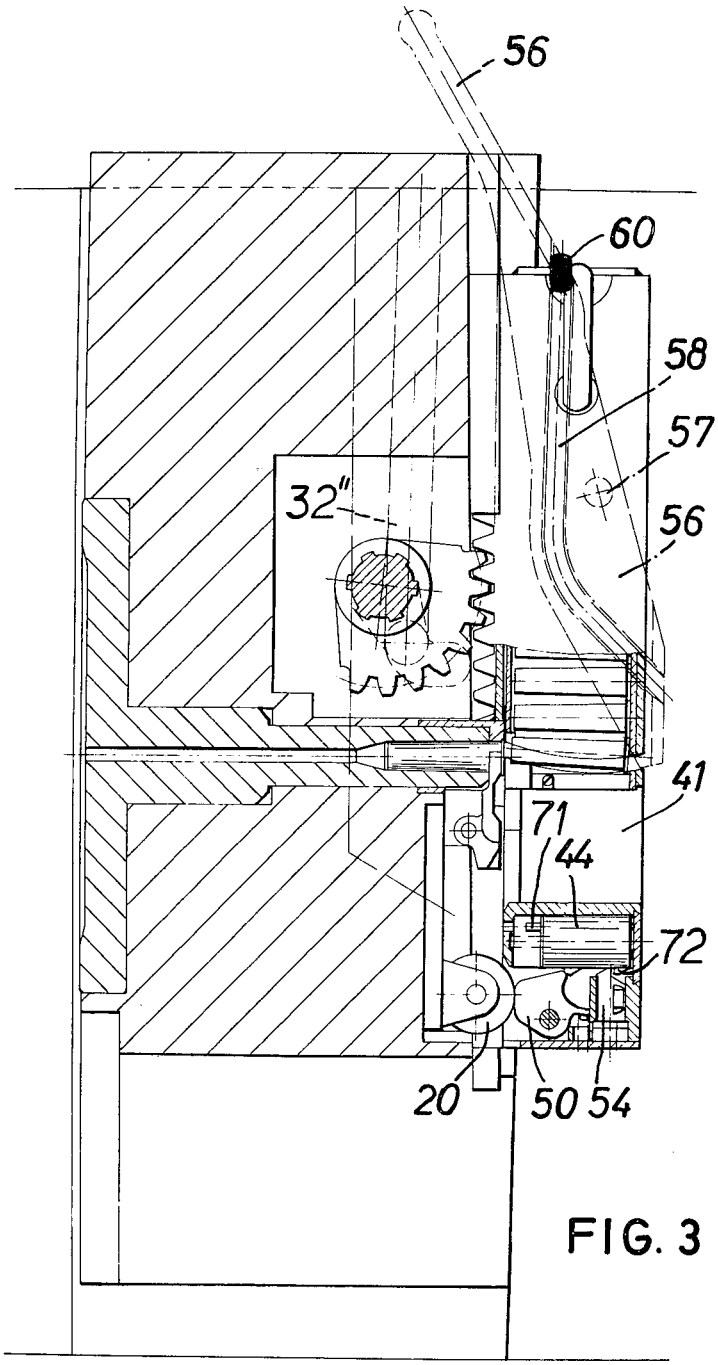
Figure 6:
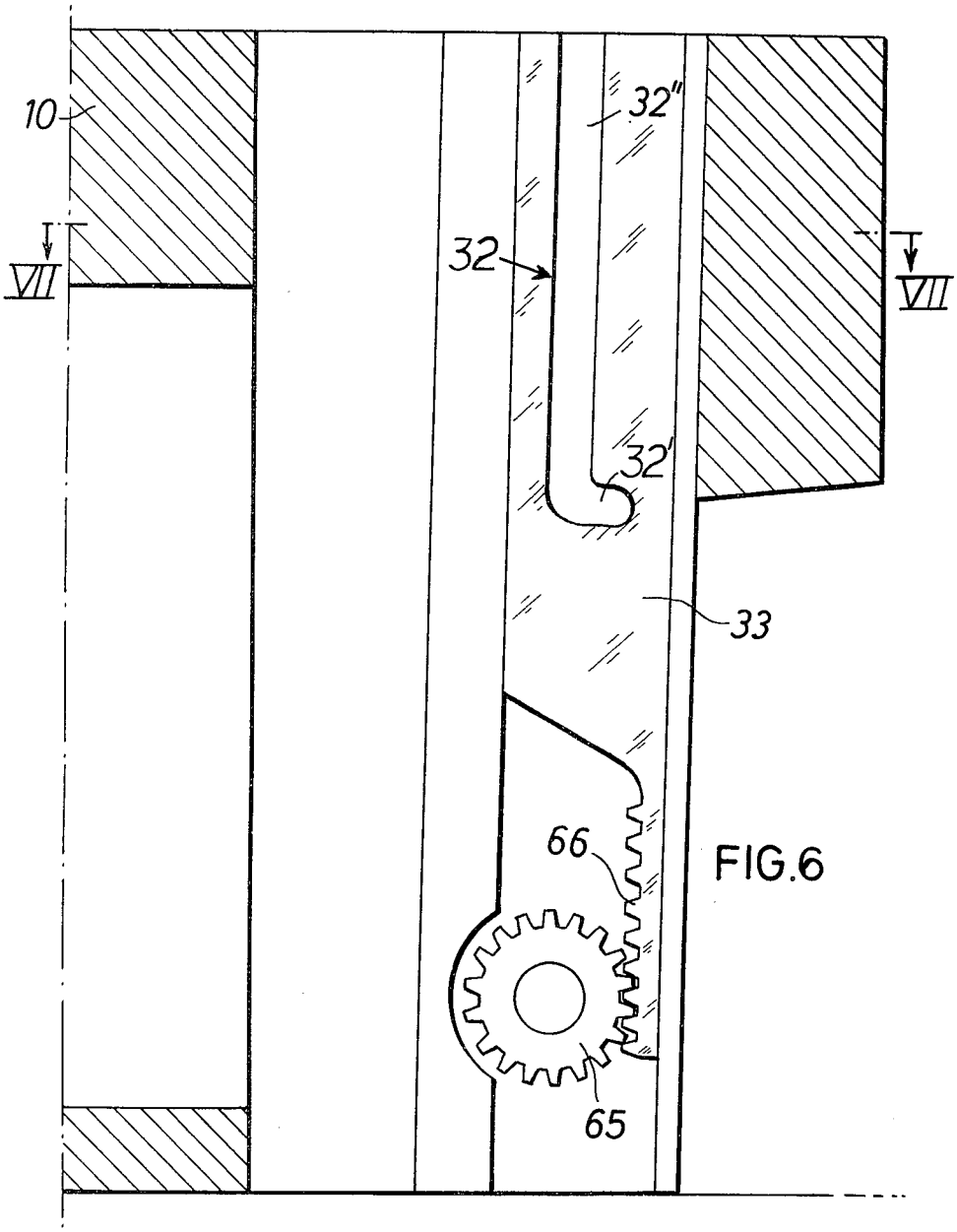
FIG. 6 is a section taken along line VI—VI of FIG. 4.
Figure 7:
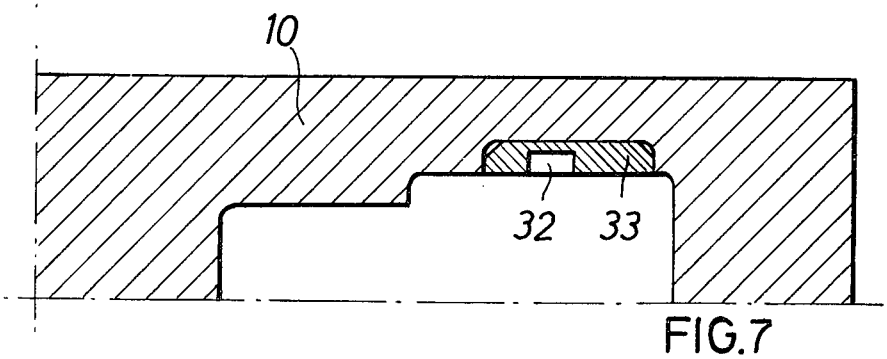
FIG. 7 is a section taken along line VII—VII of FIG. 6.

As the breech block 12 and slider 22 moves further the crank pin 30 continues to turn clockwise, a cam 50 engages the roll 20 and is turned thereby clockwise as shown in FIG. 3 so as to engage a projection or nose of the piston 44 and press the latter in a direction opposite to that of the force of a spring 52 acting thereon, as can be seen from FIG. 1. The bolt 44 is locked by means of a catch 54 engaging a projection 72 thereof. A firing mechanism not shown in the drawing acts thereon during the firing phase of the weapon.

The cartridge clip 34 moves with the slider 22 so that the lowermost cartridge 36' is aligned with the primer chamber 14. This completes the oppositely complementary motions of breech block 12 on one hand and slider 22 on the other hand. The L-shaped cam slot 32 is formed so that crank pin 30 now enters its vertical stem part 32'' (FIG. 3).

The breech block 12 has not yet, however, reached the end of its travel in the direction of arrow 12. Continuation of such travel causes the turning of a loading lever 56 (FIGS. 2 and 3) pivotable about a pin 57 mounted on the slider 22 as a result of a cam follower 60 entering a guiding groove or cam slot 58 formed in the slider 22. The lowermost cartridge 36' is thereby pushed into the primer chamber 14.

On closing of breech block 12 the latter and slider 22 resume the position shown in FIG. 1, with the crank pin 30 re-entering the foot part 32' of the L-shaped slot 32 and the loading lever 56 returned to its starting position.

As can be seen from FIGS. 4 and 5 a hand lever 62 is provided on the housing of the gun 10 and serves to displace the slider 22 independently of the breech block 12 so that the process described, i.e. ejection of a fired cartridge 36', cocking of the firing pin 71, and insertion of a new cartridge can be accomplished even when the mechanism is in the firing position, for example when a cartridge in the primer chamber 14 has failed to fire.

Upon actuation of hand lever 62 in a clockwise direction, as seen in FIG. 5, guide rail 33 formed with the cam slot 32 is displaced via a pinion 64 attached to a shaft 65, and engaging a rack 66 formed on the lower end of guide rail 33 which is slidable on the cannon.

The slider 22 is therefore displaced from a first position shown in FIG. 1 into a second position shown in FIG. 3. The loading lever 56 then inserts a new cartridge into the chamber 14. Prior to the actuation of loading lever 62 a bolt 67 must be withdrawn from its spring-actuated locking position as shown in FIG. 4. At the same time the cam 60 must be similarly disengaged from groove 58.

I claim:

1. A breech mechanism for a gun, said mechanism comprising:

a slidable breech block engageable over the ammunition chamber of said gun and having a primer-cartridge chamber, said block being slidable between a firing position with said chambers aligned and an unloading position with said block uncovering said ammunition chamber;

a slider on said block having a primer-cartridge magazine and formed with an ejection opening alignable with said primer chamber;

means for automatically displacing said slider on said block in directions opposite to the directions of sliding of said block between a first slider position corresponding to said firing position and with said magazine aligned with said primer chamber and a second slider position corresponding to said unloading position and with said ejection opening aligned with said primer chamber;

means for removing a spent primer cartridge from said primer chamber when said slider is in said second slider position and for charging a fresh primer cartridge from said magazine into said primer chamber when said slider is in said first slider position; and manually operable means for displacing said slider without displacement of said block between said slider positions with said block in said firing position to clear a misfired primer cartridge from said primer chamber.

2. The breech mechanism defined in claim 1 wherein said means for automatically displacing includes:

a first pinion pivotally mounted on said block;

a first rack formed on said slider and meshing with said pinion;

a cam normally fixed on said gun; and a cam follower operatively connected to said pinion and engaging said cam.

3. The breech mechanism defined in claim 2 wherein said cam is a cam slot, said manually operable means including means for displacing said cam slot on said gun.

4. The breech mechanism defined in claim 3 wherein said manually operable means includes:

a guide rail formed with said cam slot and provided with a second rack, said rail being slidable on said gun;

a second pinion pivoted on said gun and meshing with said second rack;

means for preventing rotation of said second pinion and therefore for preventing sliding of said rail; and means for freeing said pinion for rotation and for rotating said pinion to slide said guide rail on said gun.

5. The breech mechanism defined in claim 4 wherein said cam follower is a crank and said first pinion is carried on an axle carrying said crank.

6. The breech mechanism defined in claim 5 wherein said means for removing and charging includes a removing lever pivoted on said block and a charging lever pivoted on said slider and means for pivoting said removing lever on displacement of said slider into said second position and for pivoting said charging lever on displacement of said slider into said first position.

* * * * *